US008655254B2

(12) United States Patent
Arai et al.

(10) Patent No.: US 8,655,254 B2
(45) Date of Patent: Feb. 18, 2014

(54) LUBRICANT APPLICATOR, IMAGE FORMING APPARATUS, AND METHOD OF MOUNTING LUBRICANT APPLICATOR

(75) Inventors: Yuji Arai, Kanagawa (JP); Ken Amemiya, Tokyo (JP); Toshio Koike, Tokyo (JP); Michiya Okamoto, Kanagawa (JP); Takuma Iwasaki, Kanagawa (JP); Hiroyuki Nagashima, Kanagawa (JP); Fumihito Itoh, Kanagawa (JP); Hiroshi Ono, Tokyo (JP); Masahiko Shakuto, Kanagawa (JP); Kaoru Yoshino, Tokyo (JP); Satoshi Hatori, Kanagawa (JP); Yuta Azeyanagi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 728 days.

(21) Appl. No.: 12/923,359

(22) Filed: Sep. 16, 2010

(65) Prior Publication Data

US 2011/0076075 A1 Mar. 31, 2011

(30) Foreign Application Priority Data

Sep. 28, 2009 (JP) ..... 2009-222521

(51) Int. Cl.
*G03G 21/00* (2006.01)

(52) U.S. Cl.
USPC ..... 399/346; 29/428; 184/14

(58) Field of Classification Search
USPC ..... 399/343, 346; 29/428; 184/14, 99
See application file for complete search history.

(56) References Cited

U.S. PATENT DOCUMENTS

| | | | | |
|---|---|---|---|---|
| 7,343,132 | B2 | 3/2008 | Kimura et al. | |
| 7,430,377 | B2 | 9/2008 | Koike et al. | |
| 7,693,475 | B2 | 4/2010 | Shakuto et al. | |
| 2005/0084271 | A1 | 4/2005 | Koike et al. | |
| 2005/0164108 | A1 | 7/2005 | Murakami et al. | |
| 2006/0062612 | A1 * | 3/2006 | Kimura et al. | 399/346 |
| 2007/0209877 | A1 | 9/2007 | Arai et al. | |
| 2007/0258743 | A1 | 11/2007 | Shakuto et al. | |
| 2009/0010693 | A1 | 1/2009 | Hatori et al. | |
| 2009/0103944 | A1 | 4/2009 | Shintani et al. | |
| 2009/0185842 | A1 * | 7/2009 | Hatori et al. | 399/346 |

(Continued)

FOREIGN PATENT DOCUMENTS

| | | |
|---|---|---|
| JP | 11-352751 | 12/1999 |
| JP | 2005-195720 | 7/2005 |

(Continued)

*Primary Examiner* — Walter L Lindsay, Jr.
*Assistant Examiner* — Ruth Labombard
(74) *Attorney, Agent, or Firm* — Harness, Dickey & Pierce, P.L.C.

(57) ABSTRACT

A lubricant applicator includes: a lubricant application unit that is arranged so as to be in contact with a surface of an image carrier, scrapes a solid lubricant, and applies the solid lubricant onto the surface of the image carrier while moving a surface of the lubricant application unit; a lubricant holding member that holds the solid lubricant; and a lubricant biasing unit that biases the solid lubricant against the lubricant application unit. The lubricant biasing unit is housed in a housing under a state that one end of the lubricant biasing unit is held by the lubricant holding member so that a position of the one end of the lubricant biasing unit is restricted, and another end of the lubricant biasing unit is held by a biasing-unit holding member that is provided to restrict a position of the another end of the lubricant biasing unit.

18 Claims, 10 Drawing Sheets

(56) References Cited

U.S. PATENT DOCUMENTS

| | | | | |
|---|---|---|---|---|
| 2009/0241830 | A1 | 10/2009 | Koike et al. | |
| 2009/0252510 | A1 | 10/2009 | Shintani et al. | |
| 2010/0021205 | A1 | 1/2010 | Honjoh et al. | |
| 2011/0274447 | A1* | 11/2011 | Arai et al. | 399/346 |
| 2011/0274474 | A1* | 11/2011 | Arai et al. | 399/346 |
| 2012/0195661 | A1* | 8/2012 | Karasawa et al. | 399/346 |

FOREIGN PATENT DOCUMENTS

| | | |
|---|---|---|
| JP | 2006-201565 | 8/2006 |
| JP | 2006-208437 | 8/2006 |
| JP | 2007-102018 | 4/2007 |
| JP | 2007-226136 | 9/2007 |

* cited by examiner

RELATED ART

RELATED ART

LUBRICANT APPLICATOR, IMAGE FORMING APPARATUS, AND METHOD OF MOUNTING LUBRICANT APPLICATOR

CROSS-REFERENCE TO RELATED APPLICATIONS

The present application claims priority to and incorporates by reference the entire contents of Japanese Patent Application No. 2009-222521 filed in Japan on Sep. 28, 2009. The present document incorporates by reference the entire contents of Japanese application, 2008-254132 filed in Japan on Sep. 30, 2008.

BACKGROUND OF THE INVENTION

1. Field of the Invention

The present invention relates to an image forming apparatus, such as a copier, a facsimile, and a printer; and a lubricant applicator that is configured to be used for the image forming apparatus.

2. Description of the Related Art

Conventionally, a lubricant applicator that applies a lubricant onto a surface of an image carrier is known to aim improvement in a cleaning performance, improvement in a product life, and improvement in a transfer performance of a photosensitive element and an intermediate transfer belt each of which is an image carrier (for example, Japanese Patent Application Laid-open No. 2006-208437). As a typical configuration of a lubricant applicator, an application roller as a lubricant application unit, such as a brush roller or a sponge roller, is rotatably provided such that its outer circumferential surface is to be in uniform contact with an image carrier surface. A solid lubricant that is solidified from, for example, zinc stearate, is pressed onto the application roller by a lubricant biasing unit, for example, a compression spring, via a lubricant holding member. Accordingly, the solid lubricant comes in contact with the application roller while ensuring a certain pressure. With rotating, the application roller scrapes the solid lubricant and applies it onto the image carrier surface.

According to the lubricant applicator, because the solid lubricant is scraped as it is used, the height of the solid lubricant in the pressing direction becomes lower, meanwhile the spring length of the compression spring is extending. As the spring length extends, the spring pressure decreases and then the pressing force decreases, consequently, the quantity of a lubricant shaved by the application roller turns less, and the quantity of application onto the image carrier is decreased. For this reason, the quantity of application of the lubricant onto the image carrier varies from the beginning over time, so that there is a possibility that the above effects, such as improvement in a cleaning performance, improvement in a product life, and improvement in a transfer performance, may not be obtained over time.

To suppress change in the quantity of application of the lubricant onto the image carrier from the beginning over time, it is desirable to control reduction in the spring pressure over time by setting the spring constant of the compression spring to a low value. However, many of compression springs of which spring constant is set to a low value have a long free length compared with a length that is required in an actual use, and the diameter of wire of the spring is thin, consequently, there is a disadvantage that buckling tends to occur in the spring due to a pressure applied to the spring when the spring is mounted.

As a method of mounting a lubricant applicator, there are methods as described below. For example, as shown in FIG. 9, there is a method by which a solid lubricant 5 held by a lubricant holding member 5*a* to which a compression spring 7 is fixed is mounted to a housing 13 shaped in a box that has an opening on a side facing to an image carrier, and then an application roller 4 is mounted. In the apparatus, as the application roller 4 is mounted, the compression spring 7 becomes to press the solid lubricant 5 with a certain pressure. However, buckling tends to occur in the compression spring 7 at a contact point with the housing 13 shaped in box to which the compression spring 7 is not fixed, due to a pressure applied to the compression spring 7 when the compression spring 7 is mounted to the housing 13 (see FIG. 10). Furthermore, even when buckling occurs in the compression spring 7, it cannot be visually confirmed to mount the compression spring 7 again.

Moreover, as another example, as shown in FIG. 11, there is a method by which the application roller 4 is mounted to a frame 15*a* having an opening 16 also on an opposite side additionally to the side facing to the image carrier, and then after the solid lubricant 5 is mounted from the opening 16 on the opposite side, a cover 15*b* is mounted on the opening 16 on the opposite side. Notches 15*c* are provided on part of the cover 15*b*, and then a small lid 15*d* to which the compression spring 7 is fixed is fitted into each of the notches 15*c*, the compression spring 7 becomes to press the solid lubricant 5 with a certain pressure. However, also according to the apparatus, buckling easily occurs in the compression spring 7 at a contact point with the solid lubricant 5 to which the compression spring 7 is not fixed, due to being pressed when being mounted to the housing (including the frame 15*a*, the cover 15*b*, and the lids 15*d*). Furthermore, even when buckling occurs in the compression spring 7, it cannot be visually confirmed to mount the compression spring 7 again.

Moreover, Japanese Patent Application Laid-open No. 2006-201565 describes a method by which a compression spring is fixed to a lubricant holding member for a solid lubricant; a lid is provided on the other end of the compression spring, which is fixed to the lid with an adhesive seal, etc.; and the lid is fixed to an upper cover of a housing; so that the compression spring becomes to press the solid lubricant with a certain pressure.

According to the apparatus described in the Patent Document No. 2006-201565, because the both ends of the compression spring are fixed, buckling is more difficult to occur in the compression spring than in a compression spring that is not fixed. However, because the compression spring is pressed at once from a free length to a spring length in which the compression spring presses the solid lubricant with a certain pressure, there was a case in which a mounting defect was produced such that the fixing by the abovementioned adhesive seal, etc. comes off with an impetus, and buckling occurred in the compression spring. In this way, even according to the Patent Document No. 2006-201565, a countermeasure against buckling of a compression spring due to a pressure applied to the compression spring when compression spring is mounted to a housing is not sufficient.

SUMMARY OF THE INVENTION

It is an object of the present invention to at least partially solve the problems in the conventional technology.

According to an aspect of the present invention there is provided a lubricant applicator including: a lubricant application unit that is arranged so as to be in contact with a surface of an image carrier, scrapes a solid lubricant, and applies the solid lubricant onto the surface of the image carrier while moving a surface of the lubricant application unit; a lubricant holding member that holds the solid lubricant; and a lubricant biasing unit that biases the solid lubricant against the lubricant application unit. The lubricant biasing unit is housed in a housing under a state that one end of the lubricant biasing unit is held by the lubricant holding member so that a position of the one end of the lubricant biasing unit is restricted, and another end of the lubricant biasing unit is held by a biasing-unit holding member that is provided to restrict a position of the another end of the lubricant biasing unit. According to another aspect of the present invention there is provided a method of mounting a lubricant applicator. The lubricant applicator includes: a lubricant application unit that is arranged so as to be in contact with a surface of an image carrier, scrapes a solid lubricant, and applies the solid lubricant onto the surface of the image carrier while moving a surface of the lubricant application unit; a lubricant holding member that holds the solid lubricant; a lubricant biasing unit that biases the solid lubricant against the lubricant application unit; and a biasing-unit holding member that restricts a position of the lubricant biasing unit. The method includes: causing one end of the lubricant biasing unit to be held by the lubricant holding member; causing another end of the lubricant biasing unit to be held by the biasing-unit holding member; and housing the lubricant application unit, the lubricant holding member, the lubricant biasing unit, and the biasing-unit holding member into a housing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment that the present invention is applied to an image forming apparatus is explained below. First of all, a configuration and operation of an image forming. apparatus according to the embodiment is explained below.

Figure 1:
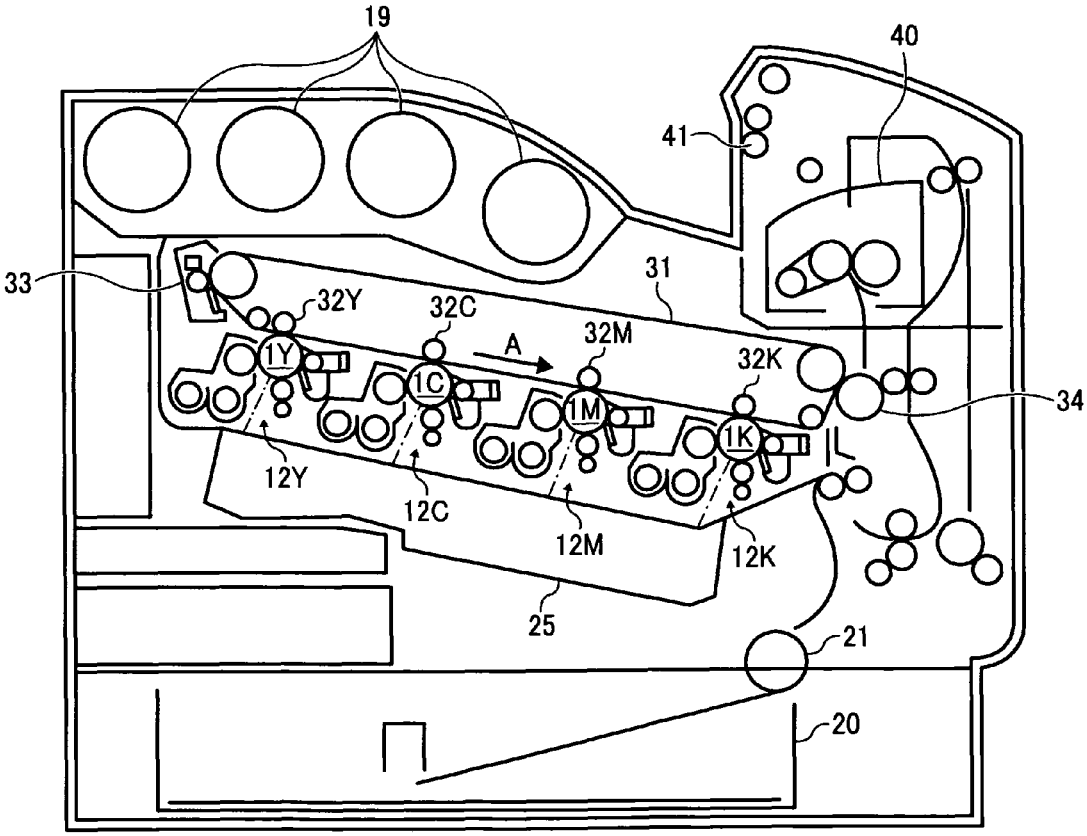
FIG. 1 is a schematic configuration diagram of a whole image forming apparatus according to an embodiment of the present invention.

FIG. 1 is a schematic configuration diagram of the whole image forming apparatus according to the embodiment. The image forming apparatus shown in FIG. 1 is a color image forming apparatus that forms an image from toners of four colors, namely, yellow (Y), cyan (C), magenta (M), and black (K). The image forming apparatus includes four image forming units 12Y, C, M, and K that form respective colors, and the image forming units are arranged along an intermediate transfer belt 31 of which surface moves in the direction of an arrow A in the figure. The image forming units 12Y, C, M, and K includes photosensitive elements 1Y, C, M, and K, respectively, each of which is an image carrier.

In the inner side of the intermediate transfer belt 31, primary transfer rollers 32Y, C, M, and K which transfer toner images onto the intermediate transfer belt 31 from the photosensitive elements 1Y, C, M, and K are provided. In a downstream from the primary transfer rollers 32Y, M, and K, a secondary transfer roller 34 is provided so as to face to the surface of the intermediate transfer belt 31. Additionally, in a downstream from the secondary transfer roller 34, a transfer cleaning device 33 that cleans the surface of the intermediate transfer belt 31 after a toner image on the intermediate transfer belt 31 is transferred is provided. In the image forming apparatus according to the embodiment, these are configured in an integrated manner, and form a transfer unit that is detachable and attachable to the main body of the image forming apparatus.

An exposure device 25 is provided below the four of the image forming units 12. Moreover, below the exposure device 25, a paper cassette 20 that accommodates transfer paper as a recording medium, and a feed unit 21 are provided. Above the secondary transfer roller 34, a fixing device 40 that fixes an image on transfer paper, and a discharging roller 41 are provided.

Figure 2:
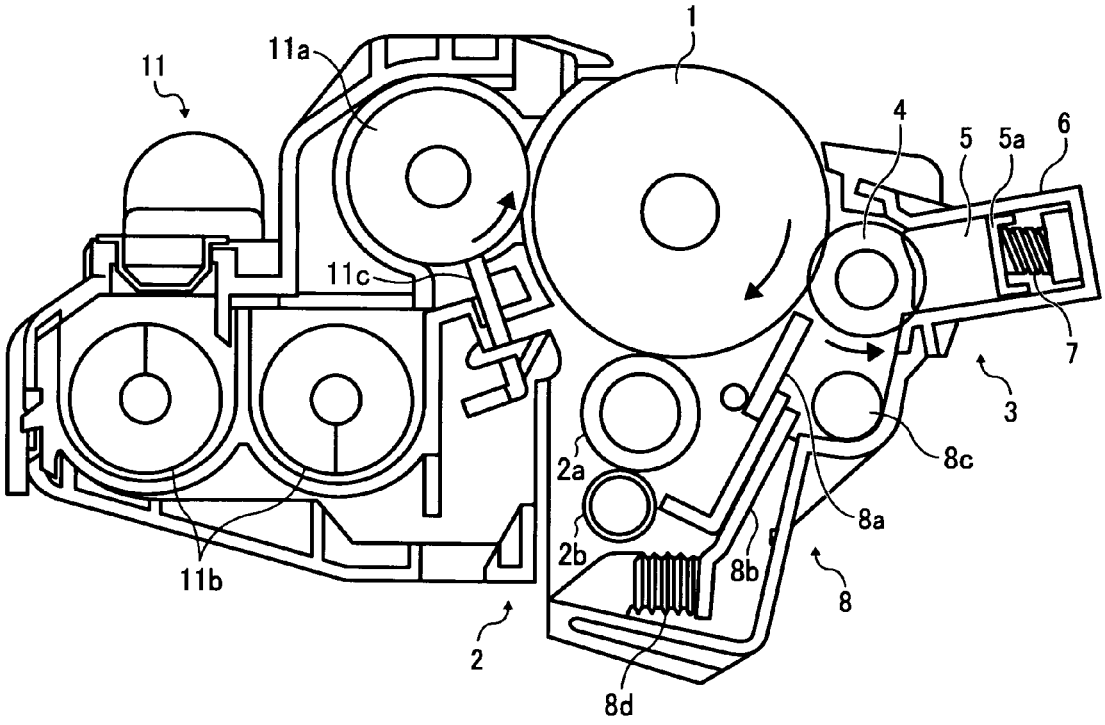
FIG. 2 is a schematic configuration diagram of an image forming unit.

FIG. 2 is a schematic configuration diagram of an image forming unit. The four of the image forming units 12Y, C, M, and K have the same configuration other than that a color of stored toner is different from each other, therefore, the related reference letters are omitted in the following explanation. In the image forming unit 12, charging unit 2 that gives a charge on the surface of the photosensitive element 1, a developing unit 11 that develops a latent image formed on the surface of the photosensitive element 1 with each color toner to a toner image, a lubricant applicator 3 that applies a lubricant onto the surface of the photosensitive element 1, and a cleaning device 8 that cleans the surface of the photosensitive element 1 after a toner image on the photosensitive element 1 is transferred are provided around the photosensitive element 1. According to the image forming apparatus of the embodiment, the image forming unit 12 is configured in an integrated manner, and forms a process cartridge that is detachable and attachable to the main body of the image forming apparatus.

Operation of the image forming apparatus is explained below. When a signal of a start of an image is received, the intermediate transfer belt 31 starts its surface movement. Simultaneously, in the image forming unit 12Y, the photosensitive element 1Y is uniformly charged by the charging unit 2Y, and is radiated with a laser light by the exposure device 25 to be form with a latent image. The latent image is developed by the developing unit 11Y, accordingly, a yellow toner image is formed on the photosensitive element 1Y. Similarly, also in the image forming units 12C, M, and K, cyan, magenta, and black toner images are formed on the photosensitive elements 1 C, M, and K, respectively. Along with the surface movement of the intermediate transfer belt 31, the respective toner images are sequentially transferred by the primary transfer rollers 32Y, C, M, and K, and a composite color image is formed on the intermediate transfer belt 31. Each of the image forming operations of the respective colors is executed by staggering timing from the upstream toward the downstream so as to transfer the toner images onto the same position on the intermediate transfer belt 31 in a superimposed manner.

Meanwhile, transfer paper has been fed by the feed unit 21 from the paper cassette 20, and conveyed to a nip between the intermediate transfer belt 31 and the secondary transfer roller 34. The composite color image on the intermediate transfer belt 31 is then transferred on the transfer paper by the secondary transfer roller 34, and a color image is recorded on the transfer paper. The transfer paper on which the image is transferred is sent into the fixing device 40, and then after the transferred image is fixed, the transfer paper is discharged by the discharging roller 41 to the outside of the apparatus. Respective residual toners on the photosensitive elements 1Y, C, M, and K after the transfer of the toner images are cleaned by cleaning devices 8Y, C, M, and K., respectively. Moreover, a residual toner on the intermediate transfer belt 31 after the transfer of the toner images is cleaned by the transfer cleaning device 33. The waste toners are discharged by a waste-toner conveying screw. (not shown) in each of the cleaning devices into a waste toner bottle (not shown) provided in the image forming apparatus.

The developing units 11Y, C, M, and K that consume the toners due to the image forming are resupplied with predetermined quantities of respective toners via not-shown conveying routes from tonner bottles 19Y, C, M, and K shown in the upper left of the FIG. 1, which are filled with yellow, cyan, magenta, and black toners, respectively.

The image forming apparatus described above includes the lubricant applicator 3 in order to aim improvement in a cleaning performance, improvement in a product life, and improvement in a transfer performance, such as a countermeasure against a worm-eaten image transfer, of the photosensitive elements 1Y, C, M, and K. The lubricant applicator 3 is explained below in detail.

Figure 3:
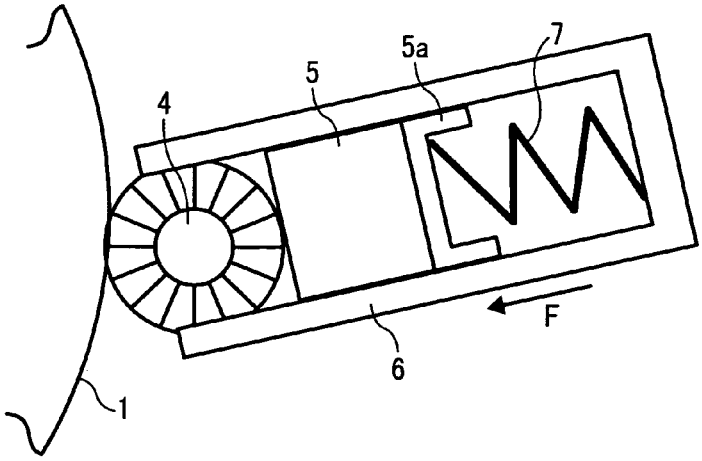
FIG. 3 is a cross-sectional view of a schematic configuration of a lubricant applicator.
Figure 4:
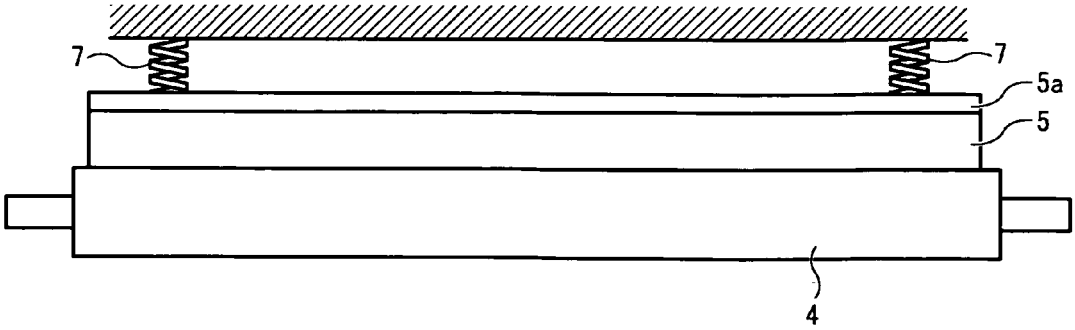
FIG. 4 is a front view of an internal configuration of the lubricant applicator.

FIG. 3 is a cross-sectional view of a schematic configuration of the lubricant applicator. FIG. 4 is a front view of an internal configuration of the lubricant applicator. The lubricant applicator 3 includes, in a housing 6 that is fixed to the image forming unit, a brush roller 4 as a lubricant application unit that is arranged such that its outer circumferential surface is in uniform contact with the surface of the photosensitive element 1, a solid lubricant 5 that is in contact with the brush roller 4, and a plurality of compression springs 7 as a lubricant biasing unit that presses the solid lubricant 5 onto the brush roller 4.

A lubricant made from a fatty acid metallic salt, a fluorine resin, or the like, can be used as the solid lubricant 5, and particularly a fatty acid metallic salt is preferable. As the fatty acid metallic salt, fatty acid metallic salts of a normal hydrocarbon, for example, myristic acid, palmitic acid, stearic acid, and oleic acid are listed; and as a metal, lithium, magnesium, calcium, strontium, zinc, cadmium, aluminum, cerium, titanium, magnesium stearate, aluminum stearate, iron stearate, and the like are preferable, and particularly, zinc stearate is preferable. The solid lubricant 5 formed by shaping such fatty acid metallic salt in a rectangle is fixed to a lubricant holding member 5*a* with a double-faced adhesive tape or an adhesive.

The solid lubricant 5 configured in this way is pressed and biased in the direction of an arrow F in the figure with the compression springs 7 via the lubricant holding member 5*a*, and caused to come in contact with the brush roller 4 while ensuring a certain pressure. With rotating, the brush roller 4 scrapes the solid lubricant 5 and applies it onto the surface of the photosensitive element 1.

According to the lubricant applicator 3, because the solid lubricant 5 is scraped as it is used, the spring pressure of the compression springs decrease and then an application quantity of the solid lubricant 5 onto the photosensitive element 1 is reduced. To suppress change in the application quantity, a decrease in the spring pressure over time is reduced by setting the spring constant of the compression spring 7 to a low value. However, many of compression springs of which spring constant is set to a low value have a long free length compared with a length that is required in an actual use, and the diameter of wire of the spring is thin, consequently, buckling tends to occur in the spring when the spring is mounted.

Figure 5:
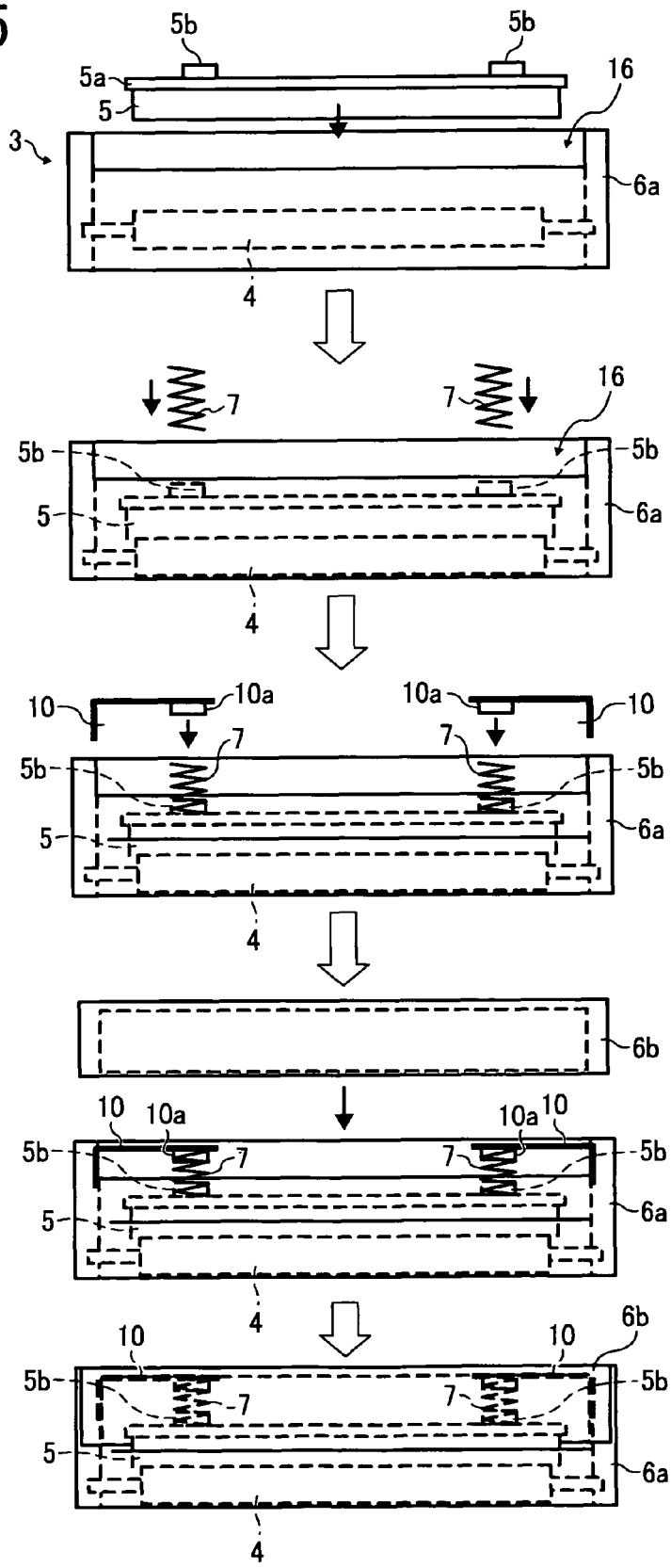
FIG. 5 is a schematic diagram for explaining mounting of a lubricant applicator according to the embodiment.

FIG. 5 is a schematic diagram for explaining mounting of the lubricant applicator 3 according to the embodiment. The lubricant applicator 3 includes the housing 6 that includes a frame 6*a* having an opening 16 on a side facing to the photosensitive element 1 as well as an opening 16 on an opposite side, and a cover 6*b* to be attached to the opening 16. To the frame 6*a*, after the application roller 4 is mounted, the solid lubricant 5 fixed to the lubricant holding member 5*a* is mounted from the upper opening 16. After that, the compression springs 7 are mounted from the upper opening 16 so as to bias the lubricant holding member 5*a*. The lubricant holding member 5*a* at a position at which the compression springs 7 are in contact with the lubricant holding member 5*a* is provided with a restricting unit 5*b* that restricts a position of the compression spring 7 and holds it. Furthermore, a biasing-unit holding member 10 including a restricting unit 10*a* that restricts a position of an end of the compression spring 7 on the side opposite to the lubricant holding member 5*a* is provided. In other words, the compression spring 7 is mounted into the frame 6*a* under a state that the compression spring 7 is held at one end by the restricting unit 5*b* of the lubricant holding member 5*a* with the position of the end restricted, and held at the other end by the restricting unit 10*a* of the biasing-unit holding member 10 with the position of the other end restricted. Accordingly, the compression spring 7 turns into a pressed state from a free length; however, buckling does not easily occur in the compression spring 7 because the positions at the both ends of the compression spring 7 are restricted. The cover 6*b* is then mounted onto the upper opening 16. In this way, the lubricant applicator 3 is mounted to the housing 6 that is formed of the frame 6*a* and the cover 6*b*.

In this way, because the biasing-unit holding member 10 and the lubricant holding member 5*a* hold the positions of the both ends of the compression spring 7, buckling of the compression spring 7 is suppressed. Moreover, because the biasing-unit holding member 10 is mounted to the frame 6*a*, buckling of the compression spring 7 is further suppressed. Furthermore, as the compression spring 7 is mounted into the frame 6*a* while being pressed, and additionally mounted with the cover 6*b*, the solid lubricant 5 is mounted so as to be housed in the housing while ensuring that the brush roller 4 comes in contact with the solid lubricant 5 with a certain pressure. Accordingly, buckling becomes far more difficult to occur in the compression spring 7 than in a conventional one in which the compression spring 7 is pressed at once when being mounted into a housing. Moreover, because the inside of the frame 6*a* can be visually observed from the upper opening 16; when mounting the biasing-unit holding member 10 into the frame 6*a* so as to hold the compression spring 7, it can be visually confirmed whether the compression spring is correctly mounted without occurrence of buckling. As the cover 6*b* is attached onto the upper opening 16 under the state that it is confirmed that the compression spring 7 is correctly mounted, the lubricant applicator 3 can be correctly mounted.

When using an elastic member as the biasing-unit holding member 10, mounting is facilitated. Specifically, as shown in FIG. 5, used is a plate spring of SUS of 0.1 millimeters to 0.2 millimeters in thickness provided with the restricting unit 10*a*. The restricting unit 10*a* includes, for example, a boss configured to be fitted inside the compression spring 7 so as to restrict the position of the compression spring 7 to prevent occurrence of buckling in the compression spring 7. By using such thin plate spring, interference with other parts is reduced, and space for the apparatus can be saved. If space is available, a resin or another material other than a plate spring can be used as the biasing-unit holding member.

When using a thin plate spring as the biasing-unit holding member 10, rigidity tends to be not ensured enough, so that the biasing-unit holding member 10 is warped. However, as it is configured to restrict the position of the compression spring 7 in its pressure application direction by the cover 6*b* at a moment of attaching the cover 6*b*, a compression height of the compression spring 7 can be surely defined at the moment when the cover 6*b* is finally attached. Accordingly, the solid lubricant 5 can be in contact with the brush roller 4 while ensuring a certain pressure.

Figure 12:
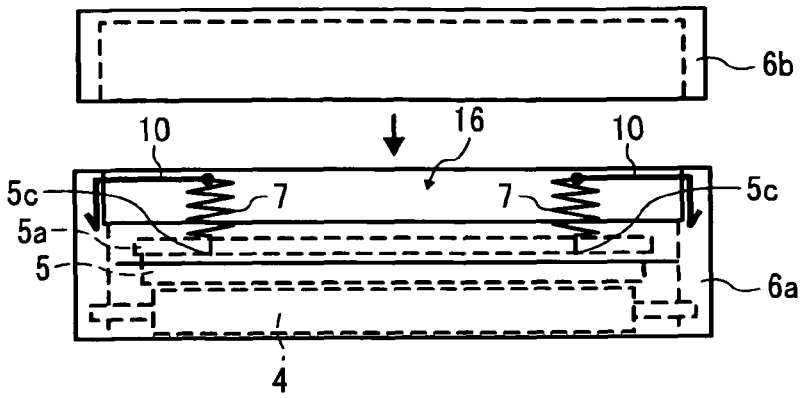
FIG. 12 is a modification of a restricting-unit holding member.

A measure of restricting the position of the compression spring 7 is not limited to the restricting units 10*a* and 5*b*. As shown in FIG. 12, a groove to which an end of the compression spring 7 is hooked may be provided to the lubricant holding member 5*a*, and the other end of the compression spring 7 may be fixed to the pressing-unit holding member 10 with, for example, an adhesive seal.

Figure 13:
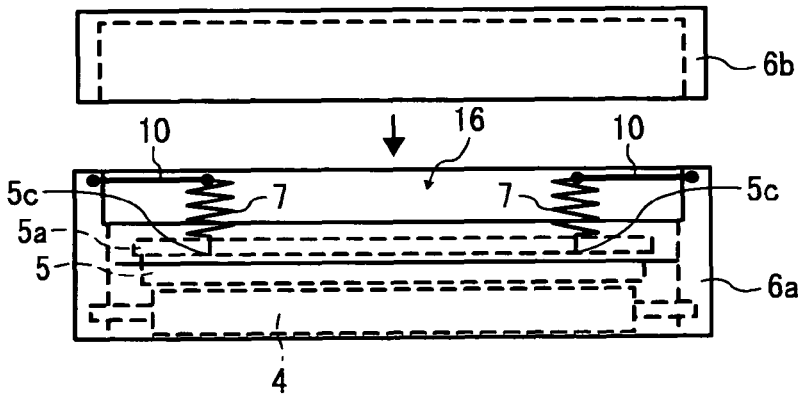
FIG. 13 is another modification of the restricting-unit holding member.

Moreover, a bent may be provided at each section at which the pressing-unit holding member 10 is mounted to the inside of the frame 6*a* and the bent portions may be hooked to the frame 6*a* as shown in FIG. 12 so that mounting can be ensured. Alternatively, a section at which the pressing-unit holding member 10 is mounted to the inside of the frame 6*a* is not limited to those shown in FIGS. 5 and 12, but may be configured as shown in FIG. 13.

Figure 14:
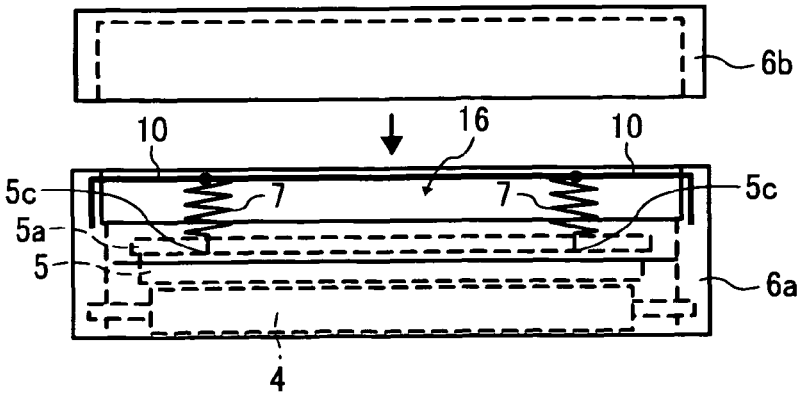
FIG. 14 is another modification of the restricting-unit holding member.

Moreover, the compression spring 7 can be stably pressed and held by the pressing-unit holding member 10 as the pressing-unit holding member is shaped so as to hold the two compression springs 7 simultaneously as shown in FIG. 14.

Figure 15:
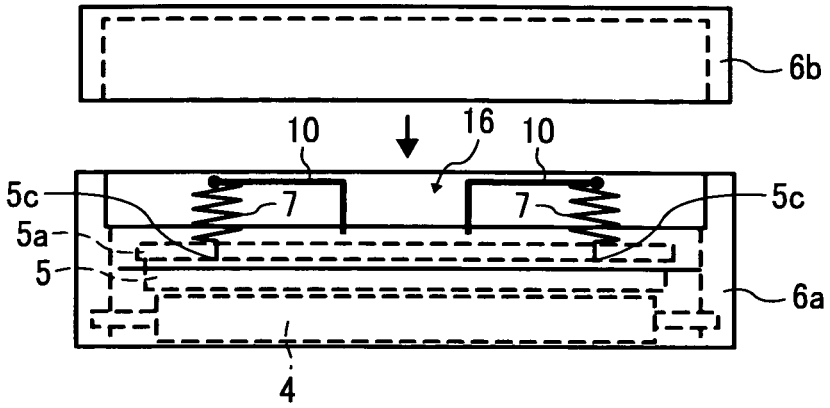
FIG. 15 is another modification of the restricting-unit holding member.
Figure 16:
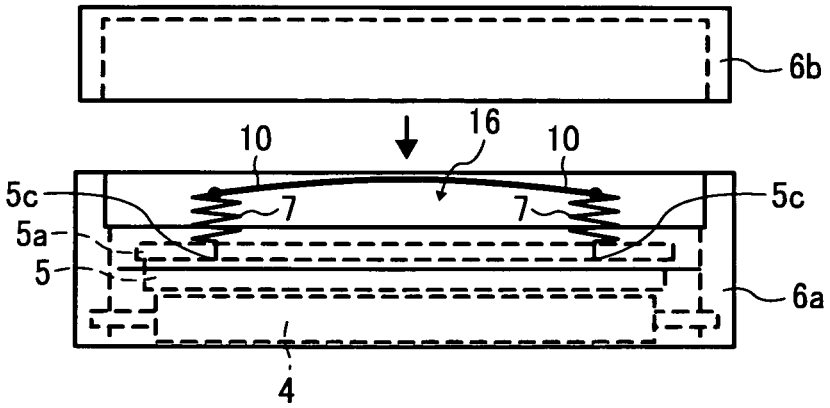
FIG. 16 is another modification of the restricting-unit holding member.
Figure 17:
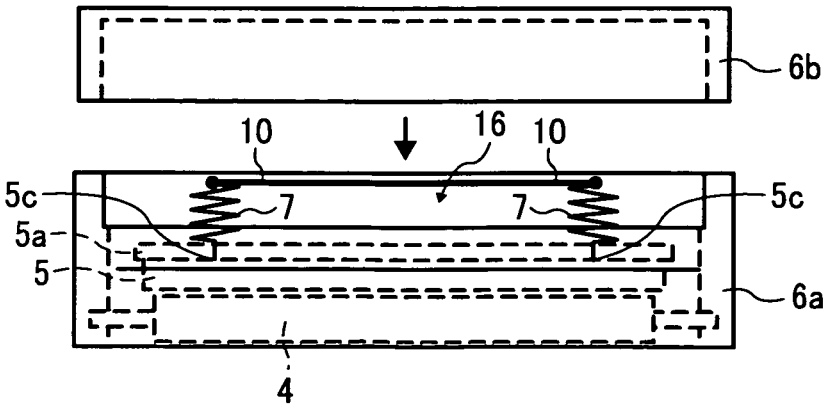
FIG. 17 is another modification of the restricting-unit holding member.

Furthermore, the pressing-unit holding member is satisfactory as long as it can be mounted inside the frame 6*a*, so that the pressing-unit holding member may be fixed to the lubricant holding member 5*a* as shown in FIG. 15. Furthermore, the pressing-unit holding member may be provided so as to connect between two of the compression springs 7 as shown in FIGS. 16 and 17, as long as it restricts the positions of the compression springs 7.

Figure 6:
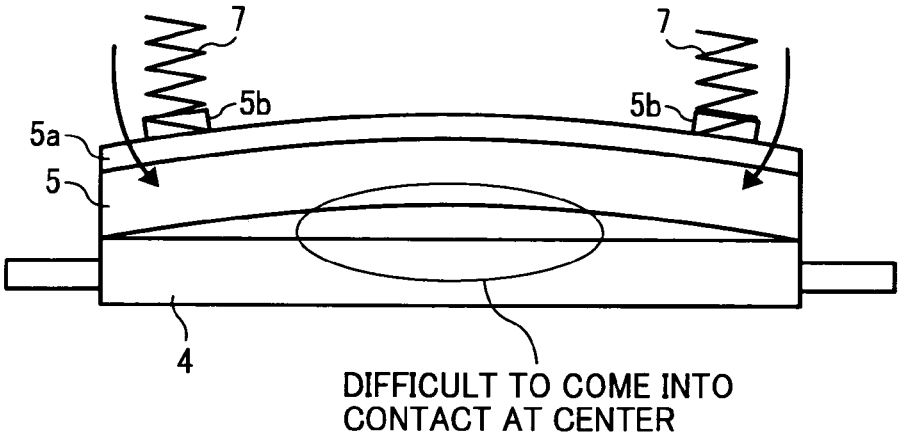
FIG. 6 is a schematic diagram for explaining a defect caused by a warp of a solid lubricant.

Moreover, there is a case where because the lubricant applicator 3 is required to save space, the lubricant holding member 5*a* is made thin so that the thickness and the bending height are not sufficient, consequently rigidity cannot be ensured. Because the rigidity of the solid lubricant 5 itself is low; if the rigidity of the lubricant holding member 5*a* is low, there is a possibility that the whole of the solid lubricant 5 may be warped due to a press by the compression spring 7. A pressing position by the compression spring 7 is often arranged at an outer side position close to an edge in the longitudinal direction. In such case, as shown in FIG. 6, there is a possibility that the center part of the solid lubricant 5 escapes due to a warp, so that a portion not in contact with the brush roller 4 is produced on the solid lubricant 5, consequently, the quantity of shaved lubricant in the beginning may not be uniform. For this reason, a portion not applied with the lubricant is produced on the photosensitive element 1, which increases the potential of a problem, for example, unsatisfactory cleaning.

Figure 7:
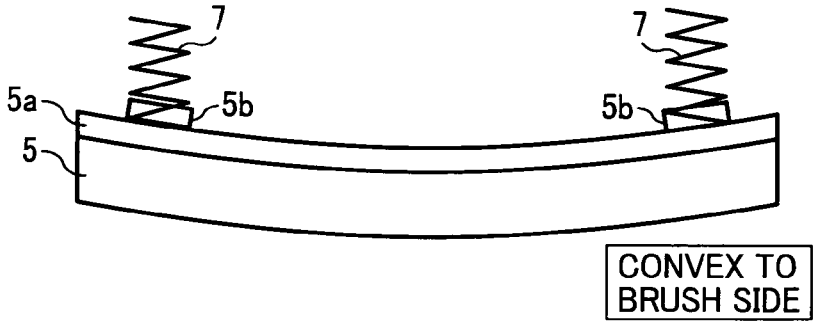
FIG. 7 is a cross-sectional view that depicts a shape of a solid lubricant.
Figure 8:
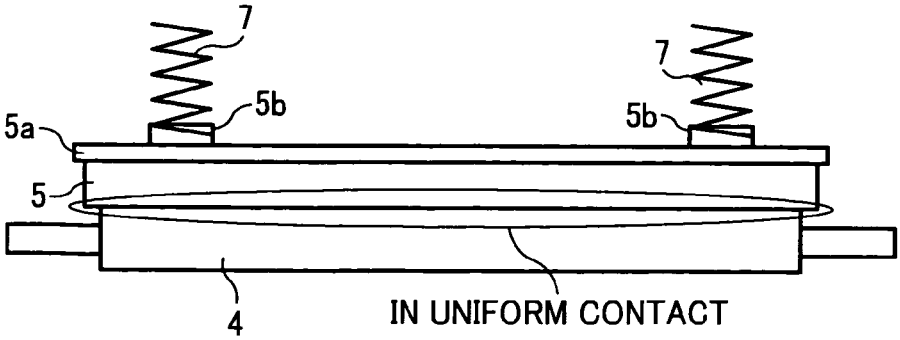
FIG. 8 is a schematic diagram for explaining a contact state of a solid lubricant.
Figure 9:
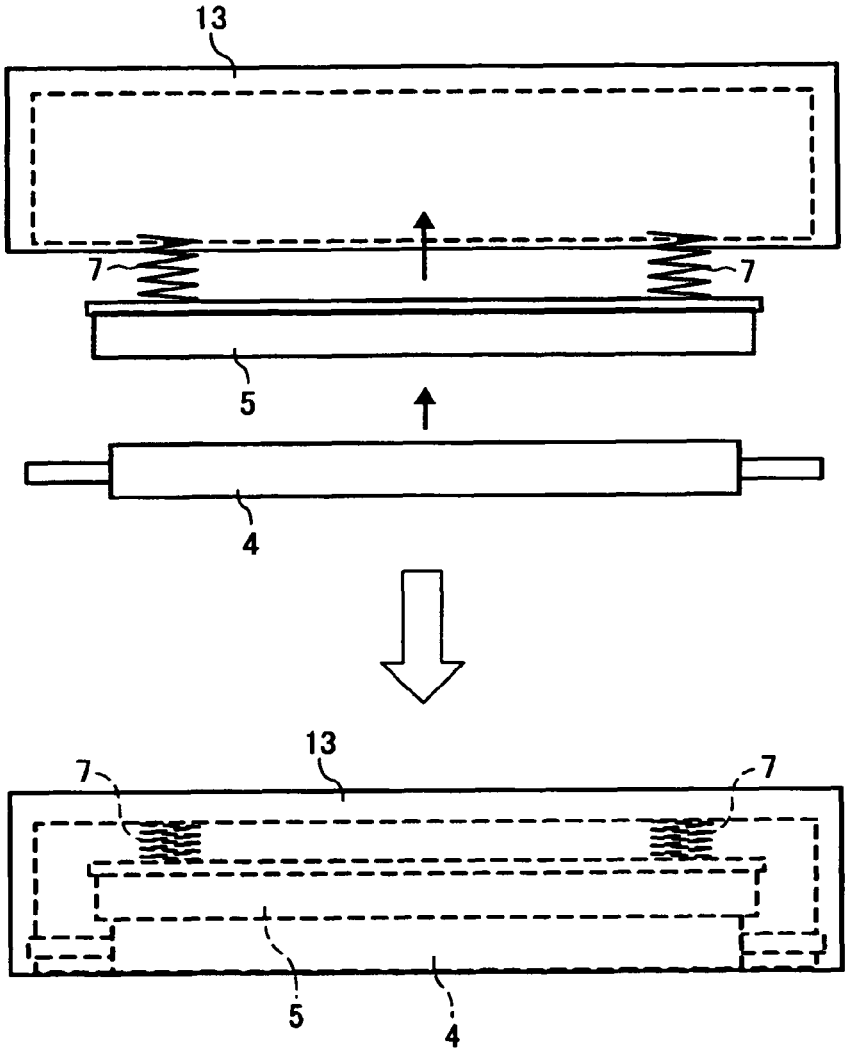
FIG. 9 is a schematic diagram for explaining an example of a method of mounting a conventional lubricant applicator.
Figure 10:
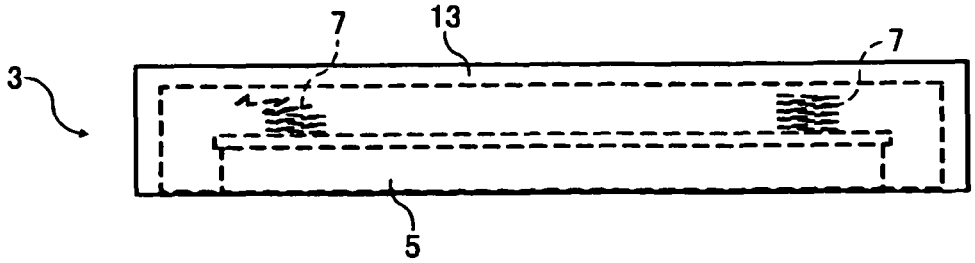
RELATED ART FIG. 10
FIG. 10 is a schematic diagram for explaining a defect of a conventional lubricant applicator.
Figure 11:
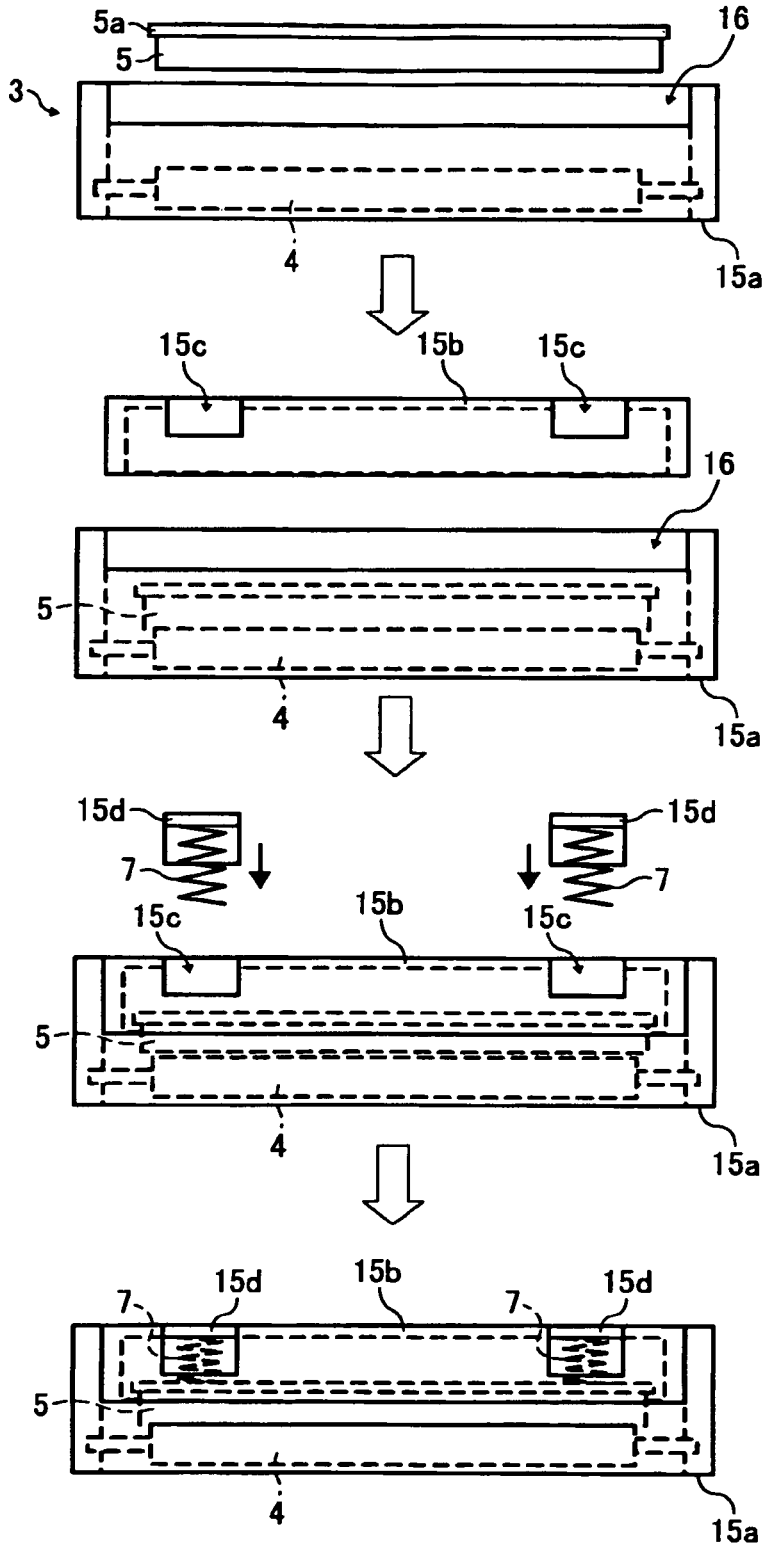
FIG. 11 is a schematic diagram for explaining another example of a method of mounting a conventional lubricant applicator.

Therefore, as shown in FIG. 7, the center part in the longitudinal direction of the solid lubricant 5 may be configured to be a convex to the lubricant application roller 4. Accordingly, when the solid lubricant 5 comes into contact with the lubricant application roller 4, they can be in uniform contact with each other as shown in FIG. 8, and a shaved quantity in the beginning can be uniformed.

Alternatively, the lubricant applicator 3 described above can be included in a transfer unit that includes the intermediate transfer belt 31 onto which toner images are transferred from the photosensitive elements 1Y, C, M, and K. Accordingly, improvement in a cleaning performance, improvement in a product life, and improvement in a transfer performance, such as a countermeasure against a worm-eaten image transfer, of the intermediate transfer belt 31 can be achieved.

Figure 18:
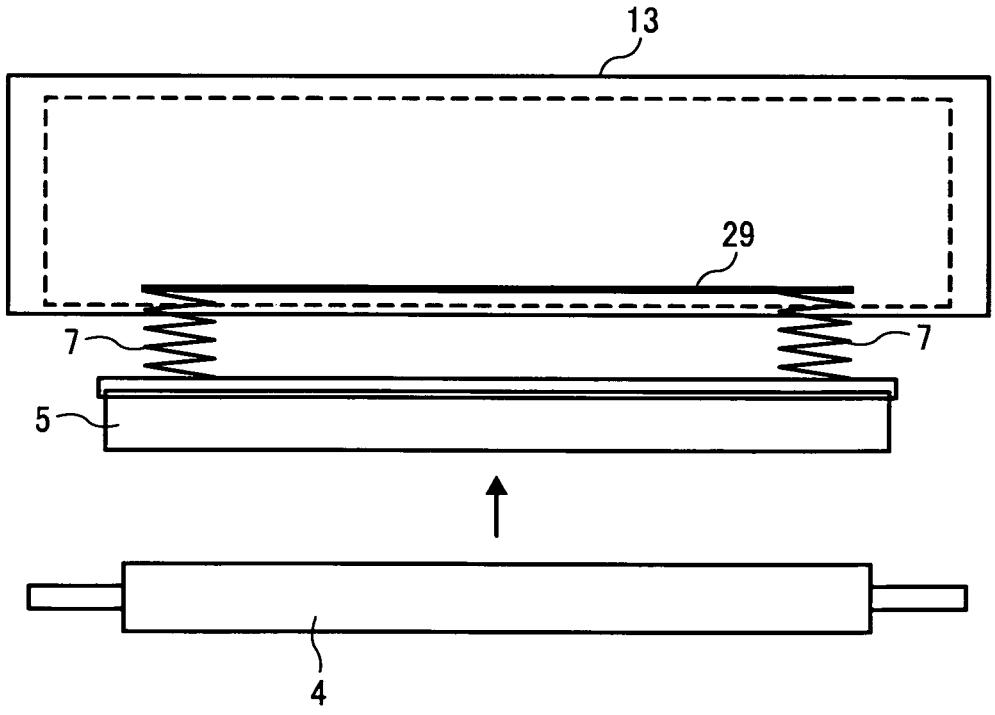
FIG. 18 is a modification of the lubricant applicator.

As described above, the present invention is explained in the embodiment by using the lubricant applicator that uses the housing 6 including the frame 6*a* having the opening on a side facing to the photosensitive element 1 as well as the opening 16 on the opposite side, and the cover 6*b*; however, the present invention is not limited to this. The present invention can be also applied to an apparatus as shown in FIG. 18 in which the housing 13 shaped in a box having an opening on a side facing to the photosensitive element 1 is mounted with the application roller 4 after being mounted with the solid lubricant 5 held by the lubricant holding member 5*a* to which two of the compression springs 7 are fixed. Specifically, as shown in FIG. 18, two of the compression springs 7 are fixed to a biasing-unit holding member 29 that holds the two of the compression springs 7 so as to restrict the positions of them, at one end opposite to the other end fixed to the lubricant holding member 5*a*. As the biasing-unit holding member 29 configured in this way is fixed, the compression spring 7 is mounted to the housing 13 under a state that the compression spring 7 is pressed from a free length. After that, as the application roller 4 is mounted, the compression spring 7 becomes to press the solid lubricant 5 with a certain pressure. In this way, after the compression spring 7 in a pressed state is mounted into the frame 6*a*, a certain pressure is ensured and contact is established. The buckling becomes more difficult to occur in the compression spring 7 than in the conventional one that is housed while pressing the compression spring 7 at once at a moment of mounting it to a housing. In this way, the embodiment is applicable to the lubricant applicator using the housing 13 shaped in a box, and a similar effect can be obtained.

As described above, according to the embodiment, the lubricant applicator 3 includes the brush roller 4 that scrapes the solid lubricant 5 and applies the solid lubricant onto the surface of the photosensitive element 1 while rotating; the compression spring 7 that presses the solid lubricant 5 against the brush roller 4; and the housing 6 that is configured to accommodate the brush roller 4 and the compression spring 7, and includes the frame 6*a* having openings on a side facing to the photosensitive element and on the opposite side, and the cover 6*b* configured to be attached on the opening 16 on the opposite side of the frame 6*a*. The compression spring 7 is mounted to the frame 6*a* under a state that the compression spring 7 is held at one end by the restricting unit 5*c* of the lubricant holding member 5*a* so that restricting the position of the one end of the compression spring 7 is restricted, and held at the other end by the restricting unit 10*a* of the biasing-unit holding member 10 so that the position of the other end is restricted, accordingly, buckling of the compression spring 7 can be suppressed. The solid lubricant 5 is then mounted to be housed into the housing 6 so as to be in contact with the brush roller 4 while ensuring a certain pressure, by mounting the compression spring 7 in a pressed state into the frame 6*a*, and further mounting the cover 6*b*. In this way, the compression spring 7 is mounted so as to be housed into the housing 6 under a state that the compression spring 7 is held and pressed by the biasing-unit holding member 10, accordingly, buckling becomes more difficult to occur in the compression spring 7 than in the conventional one that is housed by pressing the compression spring 7 at once at a moment of mounting it to a housing.

The housing 6 includes the upper opening 16 in addition to the opening on the side facing to the photosensitive element 1, accordingly, a degree of freedom in the order of mounting is increased. Furthermore, it can be visually confirmed whether they are correctly mounted inside the frame 6*a* from the upper opening 16.

The compression spring 7 is mounted to the frame 6*a* by the biasing-unit holding member 10, accordingly, buckling of the compression spring 7 can be effectively suppressed.

By using an elastic member as the biasing-unit holding member 10, mounting is facilitated.

By using a plate spring as the biasing-unit holding member 10, interference to the other parts can be reduced, and space for the apparatus can be saved.

It may be configured to restrict the position of the compression spring 7 in its pressure application direction by the cover 6*b* at a moment of attaching the cover 6*b*. The reason for this is because even when rigidity of the biasing-unit holding member 10 cannot be ensured, and the biasing-unit holding member 10 is warped; as it is configured to restrict the position of the compression spring 7 in its pressure application direction by the cover 6*b*, a compression height of the compression spring 7 can be surely defined at a moment of attaching the cover 6*b*. Accordingly, the lubricant can be uniformly applied onto the photosensitive element 1.

Zinc stearate is preferable as a solid lubricant, and by applying it, improvement in a cleaning performance, improvement in a product life, and improvement in a transfer performance can be achieved.

The center part in the longitudinal direction of the solid lubricant 5 is configured to be shaped in a convex to the lubricant application roller 4. The reason for this is because when a pressing position by the compression spring 7 is arranged at an outer side position close to an edge in the longitudinal direction, there is a possibility that the whole of the solid lubricant 5 may be warped due to a press by the compression spring 7, and the center part of the solid lubricant 5 escapes due to the warp, so that a portion not in contact with the brush roller 4 is produced, consequently, the quantity of shaved lubricant in the beginning may not be uniform. For this reason, as the center part is shaped in a convex to the lubricant application roller 4, a uniform contact can be achieved.

As the photosensitive element 1, the lubricant applicator 3, and any of at least the charging unit 2, the cleaning device 8, and the developing unit 11 are formed in an integrated manner into a process cartridge that is detachable and attachable to the main body of the image forming apparatus, improvement in the performance of maintenance can be achieved.

As the lubricant applicator 3 is employed in a transfer unit that includes the intermediate transfer belt 31, improvement in a cleaning performance, improvement in a product life, and improvement in a transfer performance, such as a countermeasure against a worm-eaten image transfer, can be achieved.

As a process of mounting the biasing-unit holding member 10 to the frame 6*a* on a side of the housing 6 to be mounted with the application roller 4 is included, buckling of the compression spring 7 can be further suppressed.

As the lubricant holding member 5*a* is housed into the frame 6*a* of the housing 6 after the application roller 4 is housed into the frame 6*a*, setting of the compression spring 7 to the restricting unit 5*b* of the lubricant holding member 5*a* and the restricting unit 10*a* of the biasing-unit holding member 10 can be carried out more easily, and holding of the position of the biasing unit can be more securely performed.

According to embodiments of the present invention, as both ends of a lubricant biasing unit are held by the lubricant holding member and the biasing-unit holding member, the lubricant biasing unit turns into a pressed state from a free length; however, buckling does not easily occur because the positions at the both ends of lubricant biasing unit are restricted. The lubricant biasing unit is housed into a housing in this state, and is mounted to be in a state that the lubricant biasing unit presses a solid lubricant to a lubricant application unit with a certain pressure. In this way, because the lubricant biasing unit is mounted so as to be housed in a housing under a state that the lubricant biasing unit is held and pressed by the biasing-unit holding member, buckling is more difficult to occur in the lubricant biasing unit than in a conventional lubricant biasing unit that is housed while pressing it at once at a moment of mounting it to a housing.

Moreover, according to a method of mounting the lubricant applicator according to the embodiment of the present invention, the biasing unit can be set while confirming that its position is held by restricting members of the lubricant holding member and the biasing-unit holding member.

As described above, according to the embodiment of the present invention, there is an advantageous effect that the lubricant biasing unit can be correctly mounted by preventing occurrence of buckling in it.

Moreover, according to the method of mounting the lubricant applicator according to the embodiment, because the biasing unit can be set while confirming that its position is held by the restricting members of the lubricant holding member and the biasing-unit holding member, there is an advantageous effect that the holding of the position of the biasing unit can be securely performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant applicator comprising:

a lubricant application unit that is arranged so as to be in contact with a surface of an image carrier, scrapes a solid lubricant, and applies the solid lubricant onto the surface of the image carrier while moving a surface of the lubricant application unit;

a lubricant holding member that holds the solid lubricant; and a lubricant biasing unit that biases the solid lubricant against the lubricant application unit, wherein the lubricant biasing unit is housed in a housing under a state that one end of the lubricant biasing unit is held by the lubricant holding member so that a position of the one end of the lubricant biasing unit is restricted, and another end of the lubricant biasing unit is held by a biasing-unit holding member that is provided to restrict a position of the another end of the lubricant biasing unit, and wherein the housing is configured to be able to open on a side opposite to the lubricant application unit with respect to a lubricant application unit contact side of the solid lubricant.

2. The lubricant applicator according to claim 1, wherein the biasing-unit holding member is mounted on a side of the housing on which the lubricant application unit is housed.

3. The lubricant applicator according to claim 2, wherein the biasing-unit holding member is made of an elastic material.

4. The lubricant applicator according to claim 1, wherein the biasing-unit holding member is in a thin plate shape.

5. The lubricant applicator according to claim 1, wherein a position of the biasing-unit holding member in a biasing direction is restricted by the housing.

6. The lubricant applicator according to claim 1, wherein the solid lubricant includes zinc stearate.

7. The lubricant applicator according to claim 1, wherein the solid lubricant is shaped in a convex at a center in a rotational axis direction of the lubricant application unit.

8. The lubricant applicator according to claim 1, wherein the housing includes a frame having a first opening on a first side facing to the surface of the image carrier and a second opening on a second side opposite the first side.

9. The lubricant applicator according to claim 8, further comprising a cover attachable to the second opening.

10. The lubricant applicator according to claim 1, wherein at least one of the lubricant holding member and the biasing-unit holding member includes a lubricant biasing unit restricting member.

11. An image forming apparatus comprising:

an image carrier;

a latent-image forming unit that creates a latent image on the image carrier;

a developing unit that develops the latent image to a toner image;

a transfer unit that transfers the toner image to a recording medium; and a lubricant applicator, wherein the lubricant applicator comprises:

a lubricant application unit that is arranged so as to be in contact with a surface of an image carrier, scrapes a solid lubricant, and applies the solid lubricant onto the surface of the image carrier while moving a surface of the lubricant application unit;

a lubricant holding member that holds the solid lubricant; and a lubricant biasing unit that biases the solid lubricant against the lubricant application unit, and the lubricant biasing unit is housed in a housing under a state that one end of the lubricant biasing unit is held by the lubricant holding member so that a position of the one end of the lubricant biasing unit is restricted, and another end of the lubricant biasing unit is held by a biasing-unit holding member that is provided to restrict a position of the another end of the lubricant biasing unit, and wherein the housing is configured to be able to open on a side opposite to the lubricant application unit with respect to a lubricant application unit contact side of the solid lubricant.

12. The image forming apparatus according to claim 11, wherein the housing includes a frame having a first opening on a first side facing to the surface of the image carrier and a second opening on a second side opposite the first side.

13. The image forming apparatus according to claim 12, further comprising a cover attachable to the second opening.

14. The image forming apparatus according to claim 11, wherein at least one of the lubricant holding member and the biasing-unit holding member includes a lubricant biasing unit restricting member.

15. A method of mounting a lubricant applicator, wherein the lubricant applicator includes a lubricant application unit arranged in a housing, a lubricant holding member that holds a solid lubricant, a lubricant biasing unit that biases the solid lubricant against the lubricant application unit, and a biasing-unit holding member that restricts a position of the lubricant biasing unit, the method comprising:

inserting the solid lubricant and the lubricant holding member into the housing from a side opposite the lubrication application unit;

inserting one end of the lubricant biasing unit into the housing to be held in a fixed position by the lubricant holding member; and inserting the biasing-unit holding member into the housing such that another end of the lubricant biasing unit is be held by the biasing-unit holding member.

16. The method according to claim 15, further comprising mounting the biasing-unit holding member on a side of the housing on which the lubricant application unit is housed.

17. The method according to claim 15, wherein after the lubricant application unit is housed into the housing, the lubricant holding member is housed into the housing.

18. The method according to claim 15, further comprising inserting a cover on a side of the housing from which the lubricant application unit, the lubricant holding member, the lubricant biasing unit, and the biasing-unit holding member were inserted into the housing.

* * * * *